US005761835A

United States Patent [19]

Okajima

[11] Patent Number: 5,761,835

[45] Date of Patent: Jun. 9, 1998

[54] SNOWBOARD BOOT

[75] Inventor: Shinpei Okajima, Sakai, Japan

[73] Assignee: Shimano, Inc., Osaka, Japan

[21] Appl. No.: 914,949

[22] Filed: Aug. 20, 1997

Related U.S. Application Data

[63] Continuation of Ser. No. 579,646, Dec. 27, 1995, abandoned.

[30] Foreign Application Priority Data

Dec. 28, 1994 [JP] Japan ..... 6-327196

[51] Int. Cl.[6] ..... A43B 7/20

[52] U.S. Cl. ..... 36/89; 36/68; 36/115

[58] Field of Search ..... 36/89, 90, 68, 36/115, 140, 142, 117.5, 117.6, 69; 602/27, 65, 66; 128/882

[56] References Cited

U.S. PATENT DOCUMENTS

| | | | |
|---|---|---|---|
| 912,579 | 2/1909 | Krech et al. | 36/68 X |
| 1,174,619 | 3/1916 | Scholl | 36/68 X |
| 1,465,233 | 8/1923 | Posner | 602/65 |
| 1,952,684 | 3/1934 | Sabel et al. | 36/68 X |
| 2,261,453 | 11/1941 | Reinhart | 36/89 |
| 2,348,300 | 5/1944 | Klaus | 36/68 X |
| 3,584,622 | 6/1971 | Domenico | 36/89 X |
| 4,289,122 | 9/1981 | Mason et al. | 602/27 |
| 4,590,932 | 5/1986 | Wilkerson | 602/65 |
| 5,035,443 | 7/1991 | Kincheloe | 280/618 |
| 5,044,360 | 9/1991 | Janke | 602/27 X |
| 5,370,604 | 12/1994 | Bernardoni | 602/27 |
| 5,438,769 | 8/1995 | Mazzarolo | 36/89 X |

FOREIGN PATENT DOCUMENTS

| | | | |
|---|---|---|---|
| 0314901 | 10/1919 | Germany | 36/89 |
| 0333156 | 11/1958 | Switzerland | 36/89 |
| WO 94/26365 | 11/1994 | WIPO | A63C 9/20 |

*Primary Examiner*—Ted Kavanaugh
*Attorney, Agent, or Firm*—James A. Deland

[57] ABSTRACT

A counter mounting within a snowboard boot having a sole and an upper having a rear side, an inner side and an outer side attached to the sole. The counter includes a lower counter portion for fixing to the boot in close proximity to the sole and an upper counter portion for fixing to the lower counter portion. The upper counter portion includes an inner side upper counter portion for extending along the inner side of the upper and an outer side upper counter portion for extending along the outer side of the upper. A length of the outer side upper counter portion which extends along the outer side of the upper is greater than a length of the inner side upper counter portion which extends along the inner side of the upper.

28 Claims, 7 Drawing Sheets

FIG. 8
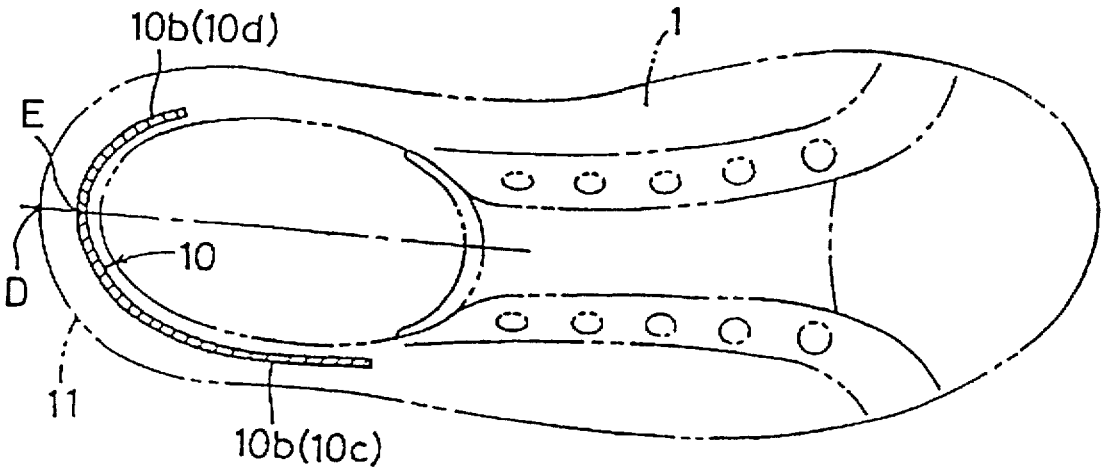
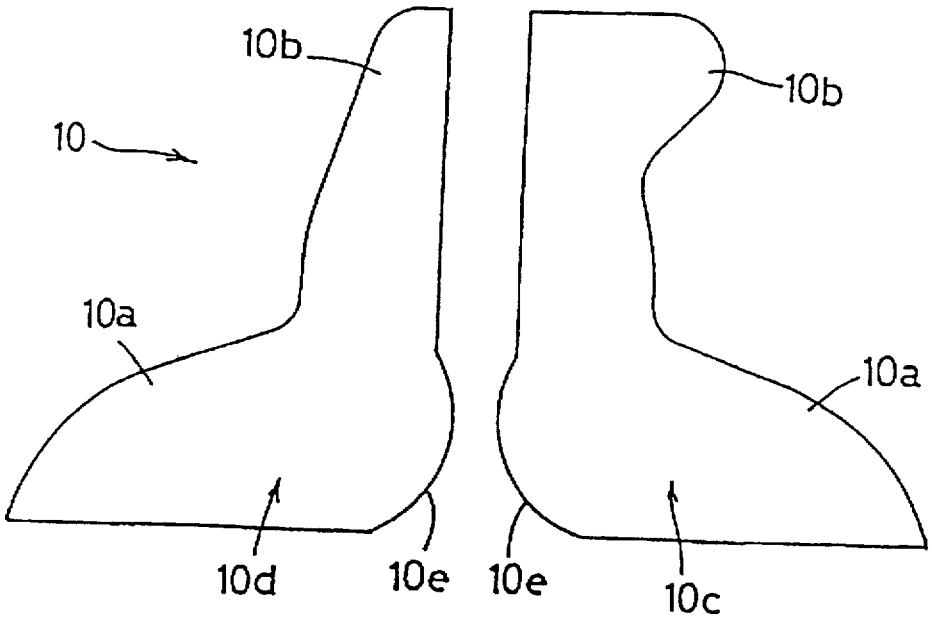
FIG. 9

SNOWBOARD BOOT

This is a continuation of application Ser. No. 08/579,646 filed Dec. 27, 1995, now abandoned.

BACKGROUND OF THE INVENTION

The present invention is directed to boots used in winter sports and, more particularly, to a boot which is used for snowboarding.

Snowboards are easier to control if the feet of the rider leans to the inside rather than to the outside. In the past, however, with boots in which the resistance to inward leaning of the foot was relatively weak and the foot readily leaned to the inside, the resistance to outward leaning of the foot was equally weak, so the foot also readily leaned to the outside. This made the snowboard relatively difficult to control. On the other hand, with boots in which the resistance to outward leaning of the foot was relatively strong and the foot did not readily lean to the outside, the resistance to inward leaning was equally strong and the foot did not readily lean to the inside either. This again made the snowboard difficult to control. Thus, a boot is needed which adequately resists outward leaning while permitting sufficient inward leaning.

SUMMARY OF THE INVENTION

The present invention is directed to structures for snowboard boots which cause the boot to adequately resist outward leaning while permitting sufficient inward leaning. One embodiment of the present invention is in the form of counter for mounting within a snowboard boot having a sole and an upper having a rear side, an inner side and an outer side attached to the sole. In this case the counter includes a lower counter portion for fixing to the boot in close proximity to the sole and an upper counter portion for fixing to the lower counter portion. The upper counter portion includes an inner side upper counter portion for extending along the inner side of the upper and an outer side upper counter portion for extending along the outer side of the upper. A length of the outer side upper counter portion which extends along the outer side of the upper is greater than a length of the inner side upper counter portion which extends along the inner side of the upper. In this way the counter provides more reinforcement to the outer side of the boot while still permitting some resiliency at the inner side of the boot.

The counter can take many forms. For example, the lower counter portion may be shaped for extending upwardly along the rear side of the upper, and/or the upper counter portion may be shaped for extending downwardly along the rear side of the upper. A fastener may be provided for attaching the upper counter portion to the lower counter portion, or else the entire structure may be integrally formed. The counter may be formed from inner and outer sections which are attached at the rear side of the boot.

Another embodiment of the invention is in the form of a boot with the counter installed within it. In this case the boot comprises a sole; an upper having a rear side, an inner side and an outer side attached to the sole; a lower counter portion retained in a rear portion of the boot in close proximity to the sole; and an upper counter portion retained in the rear portion of the boot above the lower counter portion. The upper counter portion includes an inner side upper counter portion extending along the inner side of the upper and an outer side upper counter portion extending along the outer side of the upper. A length of the outer side upper counter portion which extends along the outer side of the upper is greater than a length of the inner side upper counter portion which extends along the inner side of the upper.

As noted above, the counter can take many forms, all of which may be employed within the boot. To further stabilize the boot, an inner side lower counter portion may include a first tongue extending from a forward portion thereof, an outer side lower counter portion may include a second tongue extending from a forward portion thereof, and a fastening band may extending between the first tongue and the second tongue.

Since the boot itself is furnished with a heel counter that serves as a reinforcing means, the feet of the rider can be fastened to the snowboard such that the desired support will be realized even if a binding equipped with a back counter as the reinforcing means is not employed, e.g., even if a simple binding such as one in which the sole is merely fastened to the snowboard is employed.

BRIEF DESCRIPTION OF THE DRAWINGS

FIG. 8 is a cross section of an alternative embodiment of a heel counter according to the present invention;

FIG. 9 is a diagram showing the shape of the heel counter shown in FIG. 8;

DETAILED DESCRIPTION OF THE EMBODIMENTS

Figure 1:
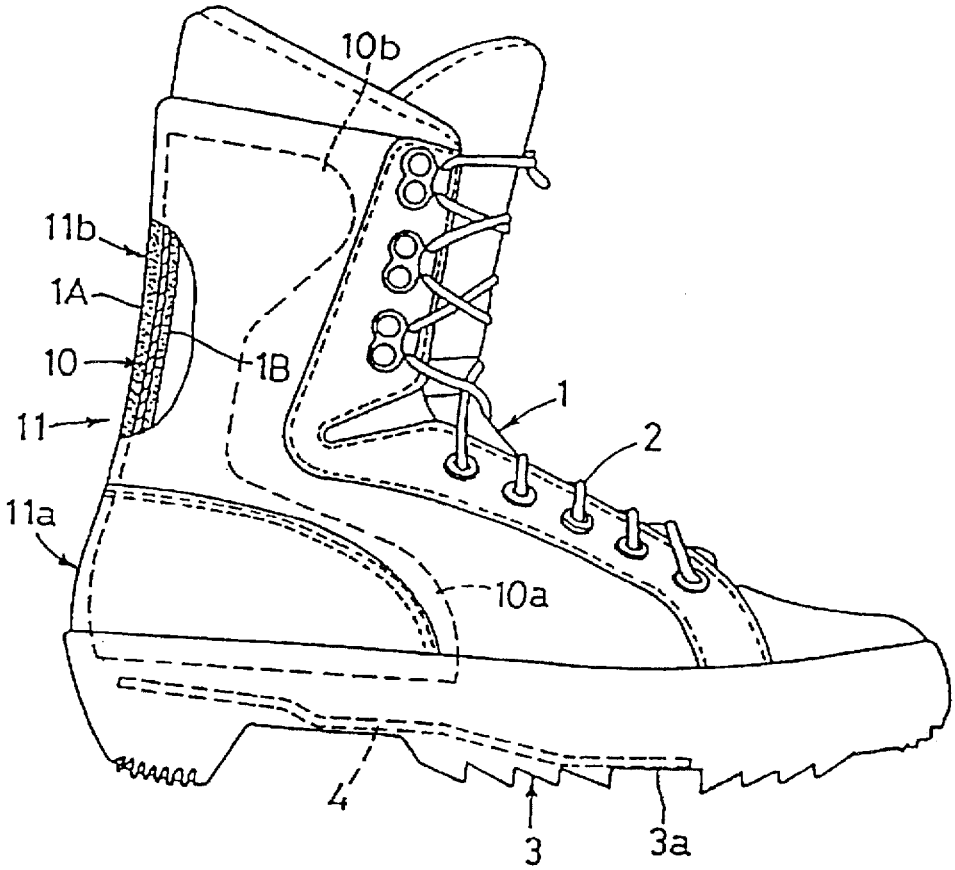
FIG. 1 is a side view of a particular embodiment of a snowboard boot according to the present invention.
Figure 6:
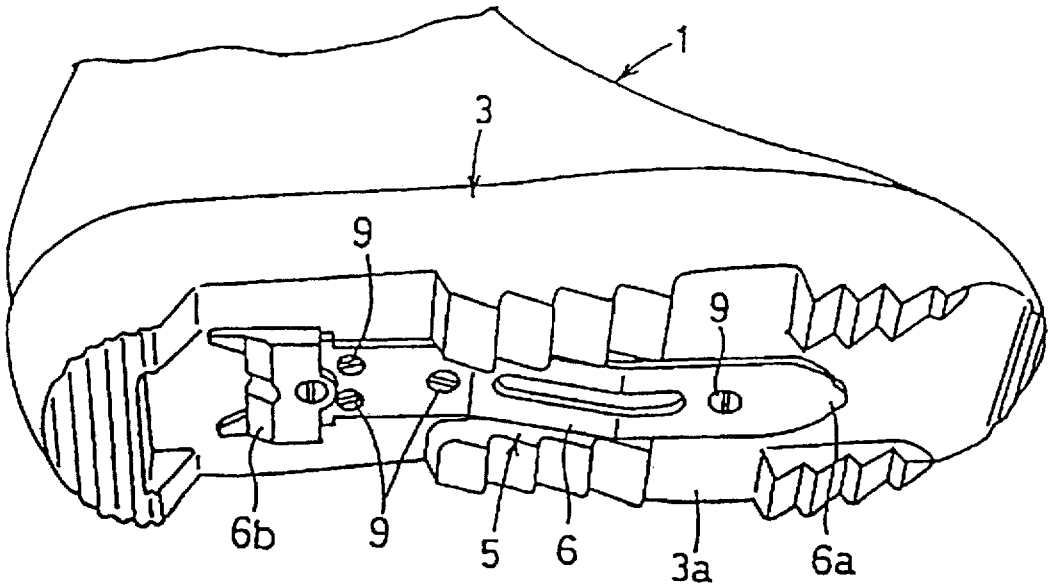
FIG. 6 is an oblique view of a particular embodiment of a sole and cleat used in a snowboard boot according to the present invention.
Figure 7:
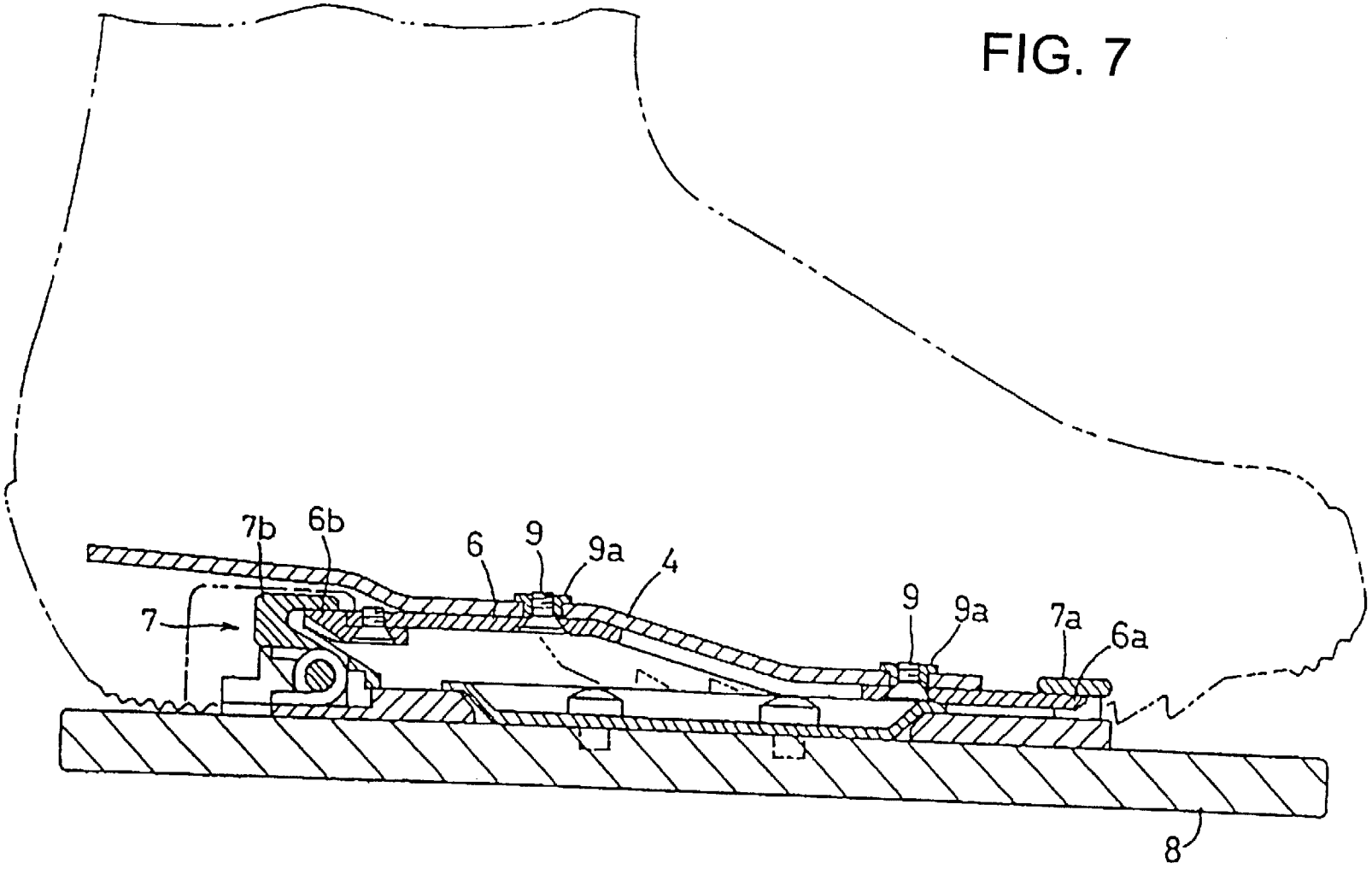
FIG. 7 is a cross section view of the sole and cleat shown in FIG. 6.

As shown in FIGS. 1 and 6, a snowboard boot is structured such that an upper 1 is tightened around the foot by a shoelace 2, and a sole 3 is equipped with an elastic out-sole 3*a*, a plate sole 4 made of a plastic plate or the like, a sole surface formed by the elastic out-sole 3*a*, and a fastener attachment depression 5 formed in this sole surface. As shown in FIGS. 6 and 7, a fastener 6 is attached to the sole 3, and the boot is bound to the snowboard 8 by this fastener 6 and a binding 7 so that the snowboard can be used. Specifically, the fastener 6 is recessed into the depression 5 and fastened by tightening to the plate sole 4 with attachment screws 9 and nuts 9*a* so that the plate sole 4 will serve as an attachment plate for attaching the fastener 6. With this construction the sole 3 will exhibit excellent fastener attachment strength, yet walking is facilitated because the fastener 6 does not readily touch the ground, while the elastic out-sole 3*a* around the fastener 6 does touch the ground. The binding 7 is equipped with a front fastener 7*a* that engages with a front engagement component 6*a* located at the front end of the fastener 6, and with a rear fastener 7*b* that engages with a rear engagement component 6*b* located at the rear end of the fastener 6, and is designed such that the front and rear sides of the sole 3 are fastened to the snowboard 8 through the fastening of the front and rear ends of the fastener 6.

Figure 2:
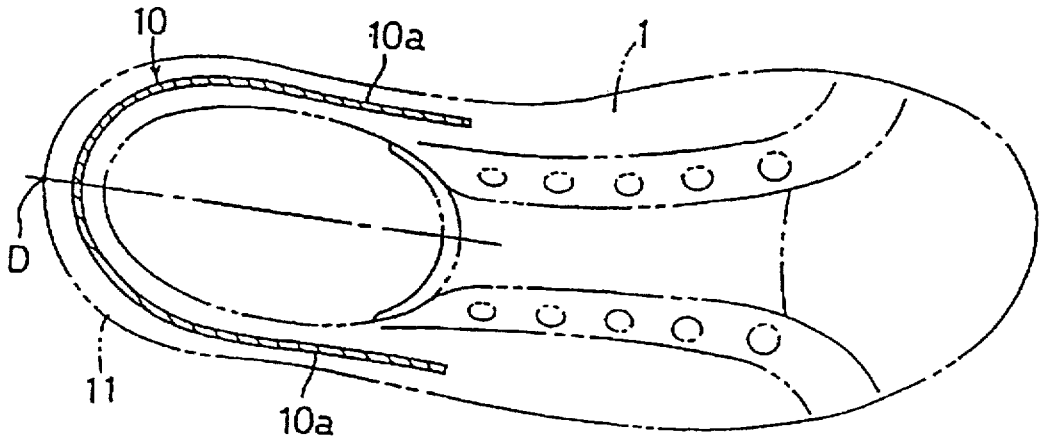
FIG. 2 is a cross section of a bottom portion of a particular embodiment of a heel counter according to the present invention.
Figure 3:
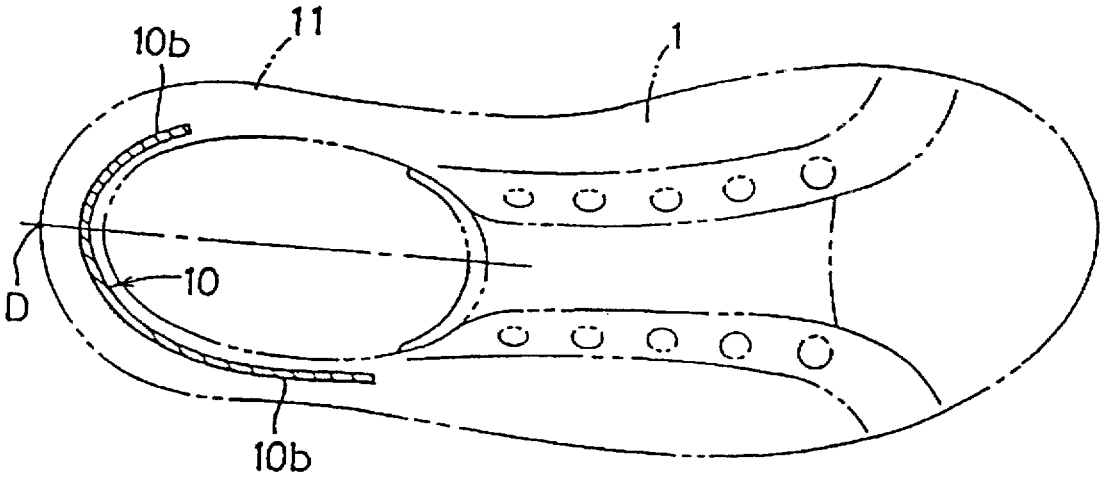
FIG. 3 is a cross section of a top side of a particular embodiment of a heel counter according to the present invention.
Figure 4:
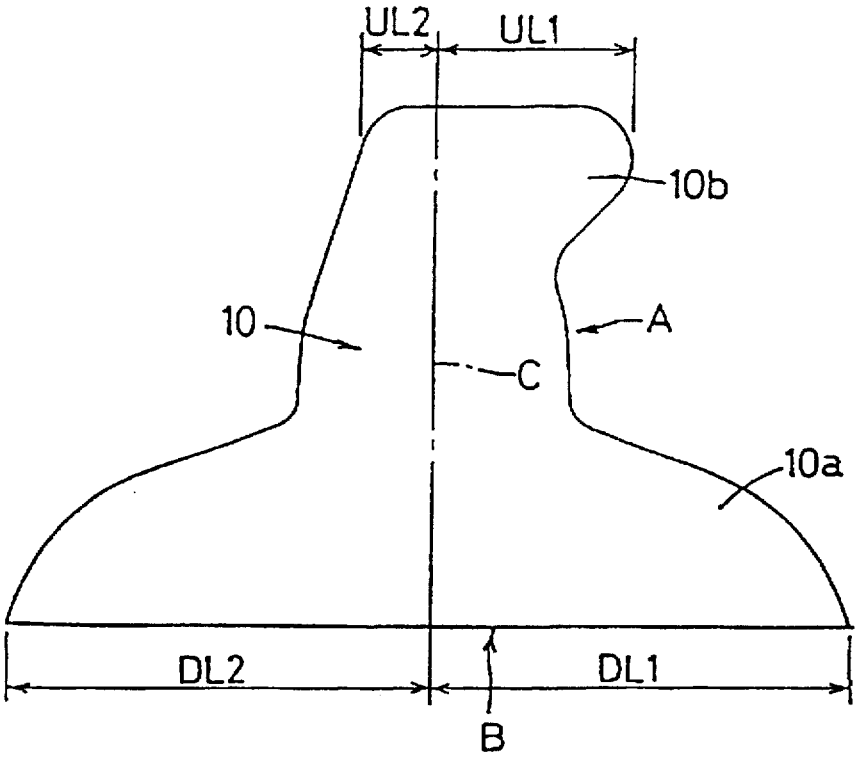
FIG. 4 is a diagram showing the shape of a particular embodiment of a heel counter according to the present invention.
Figure 5:
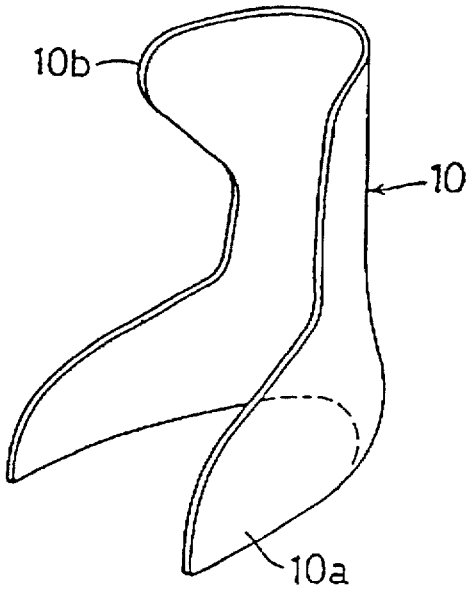
FIG. 5 is an oblique view of the heel counter shown in FIG. 4.

As shown in FIGS. 1 through 3, a heel counter 10 that reinforces the upper 1 and increases the foot support strength provided by the upper 1 is provided on the inside of the facing leather 1A between the facing leather 1A and the inning leather 1B of the upper 1. This heel counter 10 is a plastic plate with a thickness of 1 to 2 mm molded in the shape of the flat plate shown in FIG. 4, and is produced by heating this plastic plate to approximately 100° C. to soften it so that it will readily distort, and then molding it into a curved shape as shown in FIG. 5 that conforms to the stiffening leather portion 11 of the upper 1. By sandwiching heel counter 10 between the facing leather 1A and the lining leather 1B, the heel counter is not exposed to the outside yet does not come into direct contact with the foot. Thus, the boot has an attractive appearance and is comfortable to use.

More specifically, a bottom side counter portion of the heel counter is formed by a sheet portion 10*a* that goes from the constricted area A of a plastic sheet 10 to the edge B, this bottom side counter portion 10*a* is applied to the facing leather 1A along the heel portion 11*a* at the bottom portion of the stiffening leather portion 11, and the above-mentioned edge B, which is the bottom edge of this bottom side counter portion 10*a*, is fastened to the sole 3 along the bottom line of the heel portion 11*a*. A top side counter portion of the heel counter is formed by a sheet portion 10*b* that goes from the constricted area A of the plastic sheet 10 to the other edge, and this top side counter portion 10*b* is applied to the facing leather 1A along the top side portion 11*b* of the stiffening leather portion 11. As a result, the bottom side of the heel counter 10 is fastened to the sole 3, the top side follows along the stiffening leather portion 11 of the upper 1, the bottom side counter portion 10*a* of the heel counter 10 acts to reinforce the heel portion 11*a* of the stiffening leather portion 11, and the top side counter portion 10*b* acts to reinforce the top side portion 11*b* of the stiffening leather portion 11.

When the heel counter 10 is formed such that the area indicated by the imaginary line C of the plastic sheet 10 corresponds to the rear stitch line area D in the stiffening leather portion 11 of the upper 1, as shown in FIG. 2, the length DL1 that the bottom side counter portion 10*a* of the heel counter 10 extends to the outside of the boot from the rear stitch line location D is the same as the length DL2 that extends to the inside of the boot from the rear stitch line location D. However, as shown in FIG. 3, the length UL1 that the top side counter portion 10*b* of the heel counter 10 extends to the outside of the boot from the rear stitch line location D is greater than the length UL2 that extends to the inside of the boot from the rear stitch line location D. In other words, the strength provided by the portion of the stiffening leather portion 11 located to the outside of the boot for the purpose of reinforcing the heel counter 10 is greater than the strength provided by the portion of the stiffening leather portion 11 located to the inside of the boot for the purpose of reinforcing the heel counter 10, so the foot is supported such that it can lean more toward the inside than toward the outside.

FIG. 8 shows the heel counter 10 in another practical example. In this example a fastening line E located along the rear stitch line location D is present between an outer heel counter portion 10*c* located to the outside of the boot from the rear stitch line location D and an inner heel counter portion 10*d* located to the inside of the boot from the rear stitch line location D. In other words, as shown in FIG. 9, the outer heel counter portion 10*c* and the inner heel counter portion 10*d* are each separately formed from a counter material consisting of a flat plastic sheet, after which they are fastened at the above-mentioned fastening line E to create a single heel counter 10.

In this case, it is easy to produce a shape that fits closely to the heel portion 11*a* of the upper 1 despite the fact that a flat sheeting material is used. Specifically, the heel portion 11*a* has a shape that bulges outward when viewed from the side or from above. If the product of integrally molding the outer heel counter portion 10*c* and the inner heel counter portion 10*d* is employed, it is made to come into close contact over the entire surface of the heel portion 11*a* by being made to conform to the bulge of the heel portion 11*a* while the plastic sheet is heated and freely distorted. In contrast, when the product of separately molding the outer heel counter portion 10*c* and the inner heel counter portion 10*d* is employed, the portion 10*e* that is to be applied to the heel portion 11*a* of the counter portions 10*c* and 10*d* is first molded into a shape that has a suitable curved edge, so there is no need for heating and distortion in the course of actually applying these portions to the heel portion 11*a* to produce a boot. Even if heating is required, there will be a good fit over the entire surface of the heel portion 11*a* even if there is not as much distortion as in the case of an integrally molded heel counter.

Figure 10:
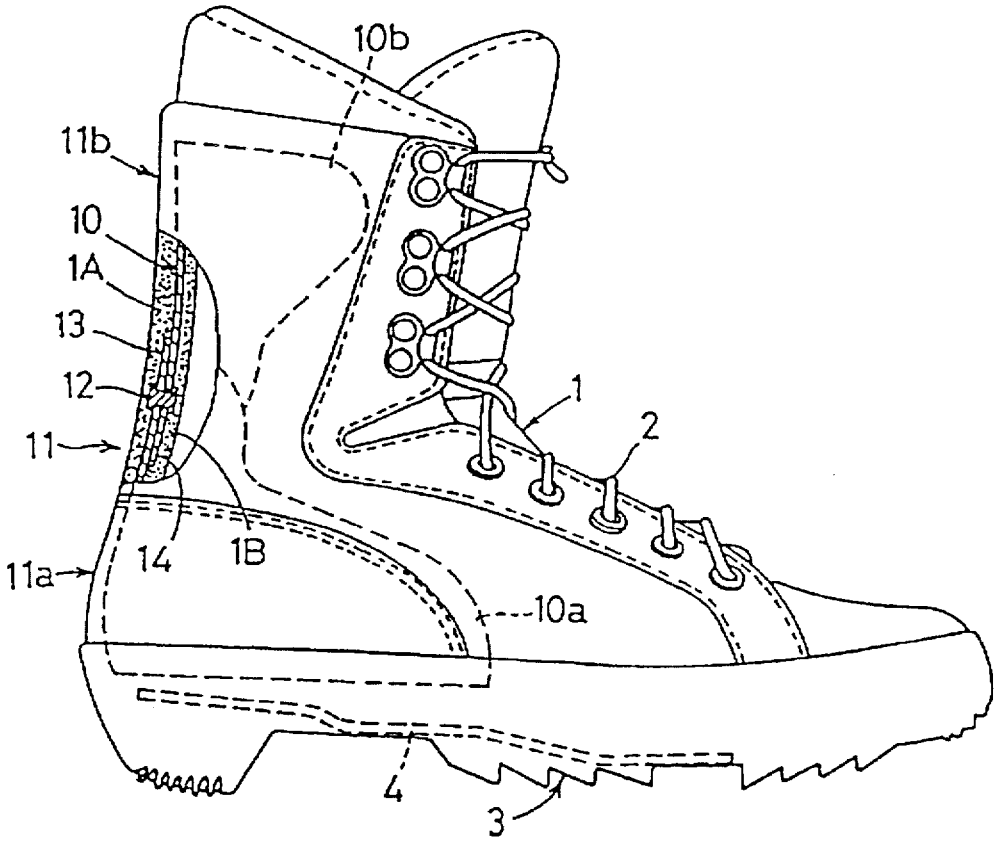
FIG. 10 is a cross section of another alternative embodiment of a heel counter according to the present invention.
Figure 11:
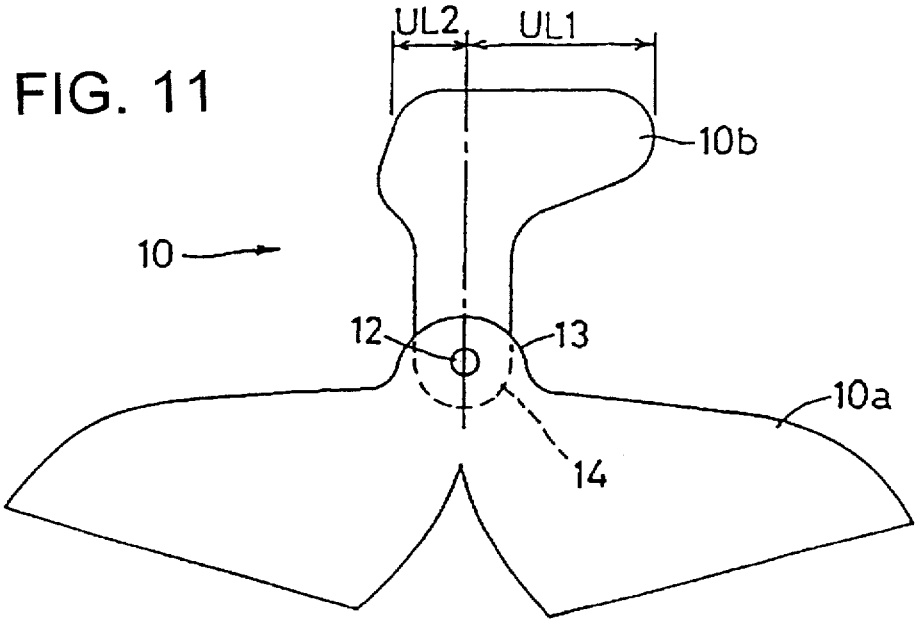
FIG. 11 is a diagram showing the shape of the heel counter shown in FIG. 10.

FIG. 10 shows the heel counter 10 in yet another practical example. In this example a fastening pin 12 that fastens the top side counter portion 10*b* and the bottom side counter portion 10*a* of the heel counter 10 is furnished between the two counter portions 10*a* and 10*b* at a location on the line at the above-mentioned rear stitch line location D. More specifically, as shown in FIG. 11, a bottom side counter portion 10*a* having a fastening portion 13 in which is located a pin hole for the fastening pin 12 is formed separately from a top side counter portion 10*b* having a fastening portion 14 in which is located a pin hole for the fastening pin 12. The fastening portions 13 and 14 are aligned and the portions are fastened so as to allow relative swinging motion, the side of the bottom side counter portion 10*a* opposite the side where the top side counter portion 10*b* is located is applied to the facing leather 1A, and that portion of the top side counter portion 10*b* where the bottom side counter portion 10*a* is located, except for the above-mentioned fastening portion 13, is applied to the facing leather 1A of the upper 1. In other words, it is possible for the top side counter portion 10*b* of the heel counter 10 to swing around the axis of the fastening pin 12 with respect to the bottom side counter portion 10*a* and, as a result, the foot insertion side of the stiffening leather portion 11 is resistant to sagging toward the rear of the boot with respect to the heel side, but at the same time, when the body is moved to the left and right because of shifts in the center of gravity, the top side counter portion 10*b* can be swung to the left and right with respect to the bottom side counter portion 10*a* around the fastening pin 12, allowing freedom to move the foot insertion opening side of the boot to the left and right.

Figure 12:
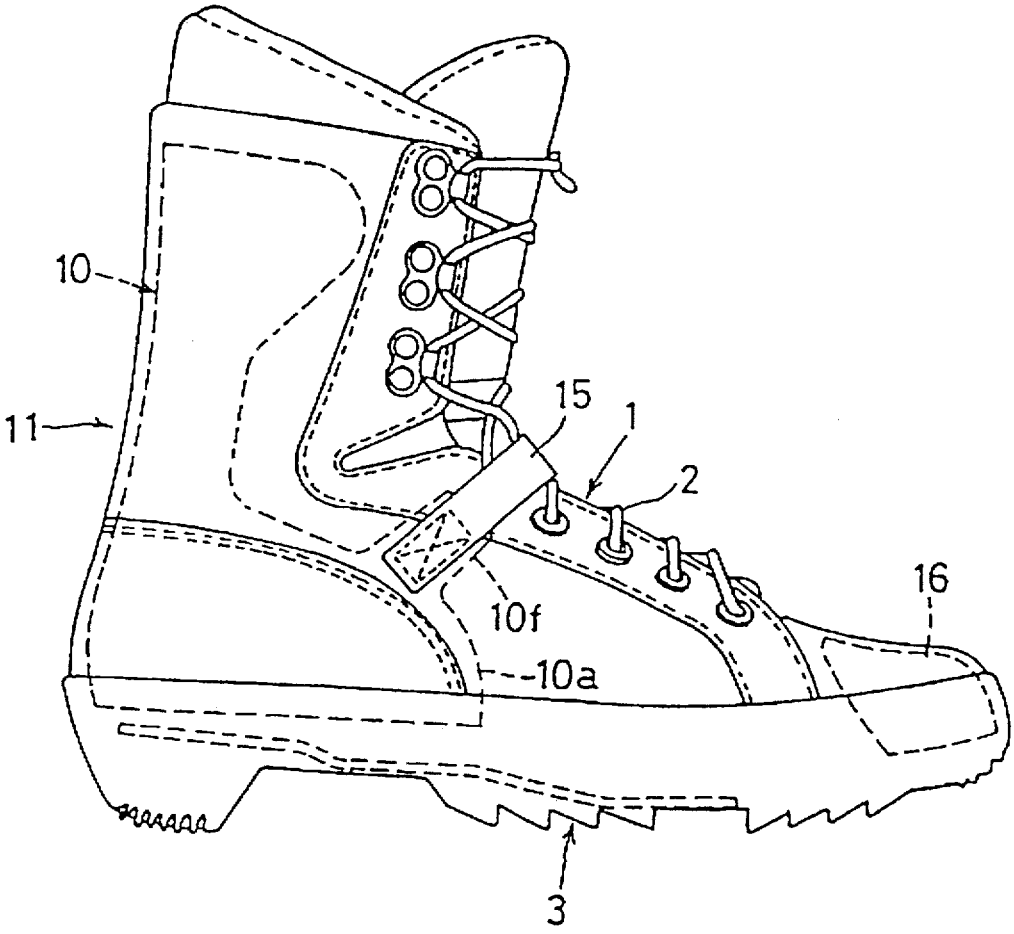
FIG. 12 is a cross section of another alternative embodiment of a heel counter according to the present invention.

FIG. 12 shows a snowboard boot having the structure of another practical example.

In this example a fastening band 15 is formed such that is passes over the shoelace 2 and is located from the left side to the right side of the upper 1. One end of the fastening band 15 is superposed over and fastened by stitching to the facing leather 1A of one of a pair of left and right tongues 10*f* that extend from the above-mentioned heel counter 10, and the other end of the fastening band 15 is fastened to the other of the above-mentioned pair of tongues 10*f* by means of a surface fastener (not shown) that has been superposed over and stitched to the facing leather 1A. A reinforcing plastic plate (not shown) having a thickness of about 0.5 to 1 mm is applied to the fastening band 15 to provide excellent tensile strength and flexural strength. In other words, the fastening band 15 serves heel counter left and right sides of the heel counter 10. As a result, rigidity is provided to the boot so that when the body weight of the rider is shifted to the front or rear of the snowboard and the left or right side of the boot is subjected to a powerful bending action, the upper 1 does not readily distort, and the front end of bottom side counter portion 10*a* of the heel counter 10 does not readily spread out, which makes the snowboard easier to control.

A toe counter 16 is formed in a curved shape so as to cover the front side of the foot, and is positioned on the inside of the facing leather of the upper 1. The bottom side of the toe counter 16 is fastened to the sole 3. When the snowboard is being ridden, and especially when it is being ridden with the front side lifted up, the rigidity provided here prevents the toe portion of the upper 1 from readily distorting, and the boot is reinforced by the toe counter 16 so that the control force will be efficiently transmitted to the snowboard.

While the above is a description of various embodiments of the present invention, further modifications may be employed without departing from the spirit and scope of the present invention. For example, one of the advantages of using a plastic sheet as the heel counter is that, for the strength it provides, it is light and easy to use, but plastic that has been integrally molded with the facing leather or lining leather of the upper may also be used, or any of a variety of materials such as leather and metal sheets may be used. An advantage of positioning the heel counter between the facing leather and the lining leather of the upper is that it can be covered by the facing leather so that it cannot be seen from the outside, but it may also be added to the outside of the facing leather.

Thus, the scope of the invention should not be limited by the specific structures disclosed. Instead, the true scope of the invention should be determined by the following claims. Of course, although labeling symbols are used in the claims in order to facilitate reference to the figures, the present invention is not intended to be limited to the constructions in the appended figures by such labelling.

What is claimed is:

1. A counter for mounting within a snowboard boot having a sole (3) and an upper (1) having a rear side, an inner side and an outer side attached to the sole (3), the counter comprising:

a lower counter portion (10*a*) for fixing to the boot in close proximity to the sole (3);

an upper counter portion (10*b*) for fixing to the lower counter portion (10*a*), the upper counter portion (10*b*) including:

an inner side upper counter portion for extending along the inner side of the upper (1);

an outer side upper counter portion for extending along the outer side of the upper (1); and wherein a length (UL1) of the outer side upper counter portion which extends along the outer side of the upper (1) is greater than a length (UL2) of the inner side upper counter portion which extends along the inner side of the upper (1); and a rear counter portion (A) for extending along a rear side of the upper (1) and coupled between the upper counter portion (10*b*) and the lower counter portion (10*a*), wherein a horizontal length from a first lateral free edge of the rear counter portion (A) to a second lateral free edge of the rear counter portion (A) is less than a horizontal length from a first lateral free edge of the upper counter portion (10*b*) to a second lateral free edge of the upper counter portion (10*b*).

2. The counter according to claim 1 wherein the lower counter portion (10*a*) is shaped for extending upwardly along the rear side of the upper (1).

3. The counter according to claim 1 wherein the upper counter portion (10*b*) is shaped for extending downwardly along the rear side of the upper (1).

4. The counter according to claim 1 wherein the lower counter portion (10*a*) is shaped for extending upwardly along the rear side of the upper (1), wherein the upper counter portion (10*b*) is shaped for extending downwardly along the rear side of the upper (1), and further comprising a fastener (12) for attaching the upper counter portion (10*b*) to the lower counter portion (10*a*) at the rear side of the upper (1).

5. The counter according to claim 1 wherein the rear counter portion is integrally formed with the upper counter portion (10*b*) and the lower counter portion (10*a*).

6. The counter according to claim 1 further comprising a fastener (12) for attaching the rear counter portion to at least one of the upper counter portion (10*b*) or the lower counter portion (10*a*).

7. The counter according to claim 1 wherein the lower counter portion includes:

an inner side lower counter portion (10*d*) for extending along the inner side of the upper (1) in close proximity to the sole (3); and an outer side lower counter portion (10*c*) for extending along the outer side of the upper (1) in close proximity to the sole (3).

8. The counter according to claim 7 further comprising:

an inner rear counter portion for fixing to the inner side lower counter portion (10*d*) and to the inner side upper counter portion; and an outer rear counter portion for fixing to the outer side lower counter portion (10*c*) and to the outer side upper counter portion.

9. The counter according to claim 8 wherein the inner rear counter portion is integrally formed with the inner side lower counter portion (10*d*) and the inner side upper counter portion, and wherein the outer rear counter portion is integrally formed with the outer side lower counter portion (10*c*) and the outer side upper counter portion.

10. The counter according to claim 9 wherein the inner rear counter portion is integrally formed with the outer rear counter portion.

11. The counter according to claim 1 wherein the lower counter portion (10*a*) is wider than the upper counter portion (10*b*).

12. The counter according to claim 1 wherein the rear counter portion (A) is narrower than the lower counter portion (10*a*).

13. The counter according to claim 12 wherein the lower counter portion (10*a*) is wider than the upper counter portion (11*b*).

14. A snowboard boot comprising:

a sole (3);

an upper (1) having a rear side, an inner side and an outer side attached to the sole (3);

a lower counter portion (10*a*) retained in a rear portion of the boot in close proximity to the sole (3);

an upper counter portion (10*b*) retained in the rear portion of the boot above the lower counter portion (10*a*), the upper counter portion (10*b*) including:

an inner side upper counter portion extending along the inner side of the upper (1);

an outer side upper counter portion extending along the outer side of the upper (1); and wherein a length (UL1) of the outer side upper counter portion which extends along the outer side of the upper (1) is greater than a length (UL2) of the inner side upper counter portion which extends along the inner side of the upper (1); and a rear counter portion (A) for extending along a rear side of the upper (1) and coupled between the upper counter portion (10*b*) and the lower counter portion (10*a*), wherein a horizontal length from a first lateral free edge of the rear counter portion (A) to a second lateral free edge of the rear counter portion (A) is less than a horizontal length from a first lateral free edge of the upper counter portion (10*b*) to a second lateral free edge of the upper counter portion (10*b*).

15. The boot according to claim 14 wherein the lower counter portion (10*a*) extends upwardly along the rear side of the upper (1).

16. The boot according to claim 14 wherein the upper counter portion (10*b*) extends downwardly along the rear side of the upper (1).

17. The boot according to claim 14 wherein the lower counter portion (10*a*) extends upwardly along the rear side of the upper (1), wherein the upper counter portion (10*b*) extends downwardly along the rear side of the upper (1), and further comprising a fastener (12) for attaching the upper counter portion (10*b*) to the lower counter portion (10*a*) at the rear side of the upper (1).

18. The boot according to claim 16 wherein the rear counter portion is integrally formed with the upper counter portion (10*b*) and the lower counter portion (10*a*).

19. The boot according to claim 16 further comprising a fastener (12) for attaching the rear counter portion to at least one of the upper counter portion (10*b*) or the lower counter portion (10*a*).

20. The boot according to claim 14 wherein the lower counter portion includes:

an inner side lower counter portion (10*d*) extending along the inner side of the upper (1) in close proximity to the sole (3); and an outer side lower counter portion (10*c*) extending along the outer side of the upper (1) in close proximity to the sole (3).

21. The boot according to claim 20 further comprising:

an inner rear counter portion retained to the boot between the inner side lower counter portion (10*d*) and the inner side upper counter portion; and an outer rear counter portion retained to the boot between the outer side lower counter portion (10*c*) and the outer side upper counter portion.

22. The boot according to claim 21 wherein the inner rear counter portion is integrally formed with the inner side lower counter portion (10*d*) and the inner side upper counter portion, and wherein the outer rear counter portion is integrally formed with the outer side lower counter portion (10*c*) and the outer side upper counter portion.

23. The boot according to claim 22 wherein the inner rear counter portion is attached to the outer rear counter portion.

24. The boot according to claim 23 wherein the inner rear counter portion is integrally formed with the outer rear counter portion.

25. The boot according to claim 20 wherein the inner side lower counter portion (10*d*) includes a first tongue (10*f*) extending from a forward portion thereof, wherein the outer side lower counter portion (10*c*) includes a second tongue (10*f*) extending from a forward portion thereof, and further comprising a fastening band (15) extending between the first tongue (10*f*) and the second tongue (10*f*).

26. The counter according to claim 14 wherein the lower counter portion (10*a*) is wider than the upper counter portion (10*b*).

27. The counter according to claim 14 wherein the rear counter portion (A) is narrower than the lower counter portion (10*a*).

28. The counter according to claim 27 wherein the lower counter portion (10*a*) is wider than the upper counter portion (10*b*).

* * * * *